US008523743B1

(12) United States Patent
Miles et al.

(10) Patent No.: US 8,523,743 B1
(45) Date of Patent: Sep. 3, 2013

(54) STRETCHING MACHINE WITH DUAL CABLE DRUM

(75) Inventors: Benjamin J. Miles, Akron, NY (US); Charles J. Kron, Lockport, NY (US)

(73) Assignee: The Blue Rooster Inc., Akron, NY (US)

( * ) Notice: Subject to any disclaimer, the term of this patent is extended or adjusted under 35 U.S.C. 154(b) by 346 days.

(21) Appl. No.: 12/941,224

(22) Filed: Nov. 8, 2010

(51) Int. Cl.
*A63B 21/002* (2006.01)
*A61H 1/02* (2006.01)

(52) U.S. Cl.
USPC ..... 482/91; 482/103; 482/131; 482/142; 482/907

(58) Field of Classification Search
USPC ..... 482/57, 91, 92, 103, 131, 135, 142, 482/143, 144, 904, 907; 602/32
See application file for complete search history.

(56) References Cited

U.S. PATENT DOCUMENTS

| | | | | | |
|---|---|---|---|---|---|
| 902,946 | A | | 11/1908 | Nise | |
| 2,633,125 | A | * | 3/1953 | Yellin | 602/36 |
| 3,984,101 | A | | 10/1976 | Garza | |
| 4,603,855 | A | * | 8/1986 | Sebelle | 482/103 |
| 4,709,918 | A | * | 12/1987 | Grinblat | 482/70 |
| 4,943,051 | A | | 7/1990 | Haskins et al. | |
| 5,029,848 | A | * | 7/1991 | Sleamaker | 482/96 |
| 5,147,266 | A | | 9/1992 | Ricard | |
| 5,324,245 | A | | 6/1994 | Fontana et al. | |
| 5,354,251 | A | * | 10/1994 | Sleamaker | 482/96 |
| 5,449,336 | A | | 9/1995 | Sabel | |
| 5,609,566 | A | | 3/1997 | Pupovic | |
| D384,117 | S | | 9/1997 | Piaget et al. | |
| 5,728,034 | A | | 3/1998 | Lamothe | |
| 6,004,248 | A | | 12/1999 | Price | |
| 6,685,607 | B1 | | 2/2004 | Olson | |
| 6,689,025 | B2 | | 2/2004 | Emick | |
| 6,733,470 | B1 | * | 5/2004 | DeGeorge et al. | 602/32 |
| 6,902,515 | B2 | | 6/2005 | Howell et al. | |
| 7,104,939 | B1 | * | 9/2006 | Martinez | 482/142 |
| 7,121,985 | B2 | * | 10/2006 | Cheng | 482/57 |
| 7,393,310 | B2 | | 7/2008 | Andrews | |
| 7,510,539 | B2 | * | 3/2009 | Katane et al. | 602/36 |
| 7,775,949 | B2 | * | 8/2010 | Bowser | 482/121 |
| D626,609 | S | * | 11/2010 | Grider | D21/694 |
| 7,857,736 | B2 | * | 12/2010 | Merrithew et al. | 482/121 |
| 8,057,368 | B1 | * | 11/2011 | Lyszczarz | 482/103 |
| 2006/0019804 | A1 | * | 1/2006 | Young | 482/93 |
| 2009/0227929 | A1 | * | 9/2009 | Gondringer | 602/33 |

FOREIGN PATENT DOCUMENTS

| | | |
|---|---|---|
| GB | 2201353 | 9/1988 |

* cited by examiner

*Primary Examiner* — Loan Thanh
*Assistant Examiner* — Victor K Hwang
(74) *Attorney, Agent, or Firm* — Simpson & Simpson, PLLC

(57) ABSTRACT

The present invention includes a user-operated stretching machine for stretching limbs and other body parts of a user. The machine includes a cable system extending from a user operated double reel cable drum to pulleys located at the end of a pair of arms extending angularly from a carriage. The carriage is attached to a curved upright in such a way as to be movably attached to the upright enabling stretching to take place at various angles relative to the upright and user's body.

18 Claims, 15 Drawing Sheets

REAR VIEW

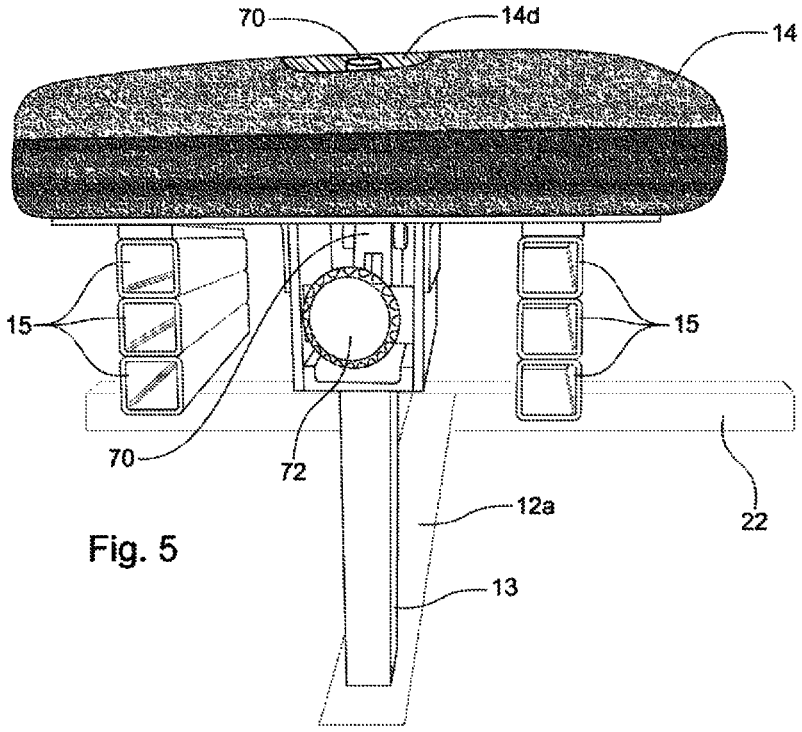
Fig. 5
Fig. 5A
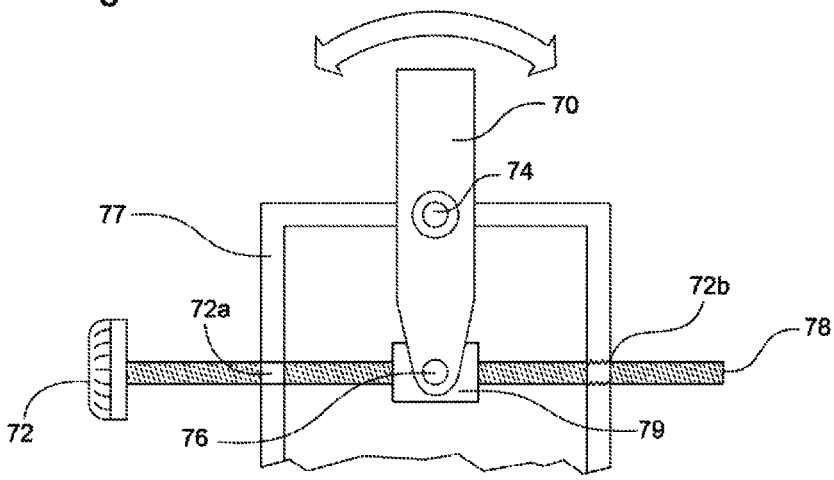

STRETCHING MACHINE WITH DUAL CABLE DRUM

FIELD OF THE INVENTION

The present invention relates generally to exercise and physical rehabilitation machines, specifically to stretching machines and more specifically to user-operated stretching machines.

BACKGROUND OF THE INVENTION

Rehabilitation of body injuries often requires extensive, long-term treatment. Frequently machines are used that are aimed at specific areas such as the shoulder or knee. These machines can be expensive and the expense can be increased if a machine cannot be adapted for use on a variety of muscles, ligaments, tendons, and joints in more than one part of the body, preferably at a variety of angles of operation. In addition, if a therapist or other person other than the patient him/herself is needed to operate the machine, further cost is incurred. Therefore, it would be advantageous if a single patient-operated machine were available that could stretch and otherwise manipulate a variety of areas of the body at different angles.

U.S. Pat. No. 7,393,310 to Andrews discloses an anterior shoulder stretching machine that is operated by the patient. A seat is provided for the user close to a foot rest that moves along an angled guide. The footrest is attached at both ends to separate cables. The user pushes on the foot rest which activates a pair of arm rests that rotate back away from the user. This stretches the user's arms backwards with the length and duration of the stretch controlled by the user's pressure on the foot rest. However, it does not allow for use at a variety of positions.

U.S. Pat. No. 6,902,515 to Howell, et al. discloses a multifunction exercise machine that includes a bicycle type pedal chain drive, a rotatable seat assembly, and a "hand pedal" type of arm/shoulder exercise device. The latter is attached to the end of an adjustable upright that extends over the seated operator. However, there is no provision for a stretching device to stretch a user's arms, shoulders or legs and/or shoulders and there is no adjustment of the angle of shoulder stretch. Essentially it only provides a way for the user to "pedal" or rotate both arms and legs.

U.S. Pat. No. 6,685,607 to Olson shows an exercise machine with an adjustable resistance assembly. Two separate cables extend respectively from a knee extension device and arm pulleys to the resistance assembly. However, it provides no component that would enable arm or shoulder stretches.

U.S. Pat. No. 5,449,336 to Sabel portrays a stretching machine that utilizes a motor driven winch holding a cable. The opposite end of the cable is secured to a ring with two stretching cables used to perform the stretching exercises.

Various horizontal bars are available to perform different exercises. It does not provide a way for the user to operate the winch, making the user dependent on a separate operator. In addition, the user must move to a variety of different locations on the machine to perform exercises at different angles.

U.S. Pat. No. 5,147,266 to Ricard presents a machine that stretches the user's legs to perform a split. The machine includes a user operated cable drum that holds two separate cables leading to left and right hand stretching racks. The '266 device does not enable the user to stretch shoulders and arms at a variety of angles.

Thus, it can be seen there is a need in the field for a singe, multi-functional, user-operated machine that enables the user to stretch different areas of the body, such as legs shoulders and arms at different angles.

SUMMARY OF THE INVENTION

The present invention broadly comprises a stretching machine comprising a base formed by a long leg and short leg, with the short leg attached substantially perpendicularly to the long leg; a curved upright extending substantially perpendicularly from the short leg of the base; a carriage adjustably mounted onto the curved upright; a pair of arms extending angularly from the carriage; a pair of carriage pulleys attached at the end of each of the pair of arms; a double reel cable drum assembly adjustably attached to the long leg; a pair of cables, each one of the pair of cables extending from one of the pedal drum reels to one of the pair of carriage pulleys; and, a seat adjustably attached to the base between the double cable reel and the curved upright.

In one embodiment, the carriage is adjustably mounted onto the upright by a gear motor and cable that allows the carriage to move to an infinite variety of positions within the range gear motor-cable system, In an alternate embodiment, the carriage is held in place by at least one pin inserted into one or more of a plurality of holes that extend along the length of the curved upright. In this alternate embodiment, the carriage is moved by removing the at least one pin and moving it by hand to a different hole(s).

One object of the invention is to provide a stretching machine that may be adapted to enable the user to stretch different parts of the body at different angles.

A second object of the invention is to enable a user to operate the stretching machine without assistance.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which:

FIG. 5 depicts one embodiment of an adjustable receiver for the back rest for use with the bench;

FIG. 5A is a schematic side view of the adjustment mechanism for the adjustable back rest of the present invention;

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figures 1, 1A:
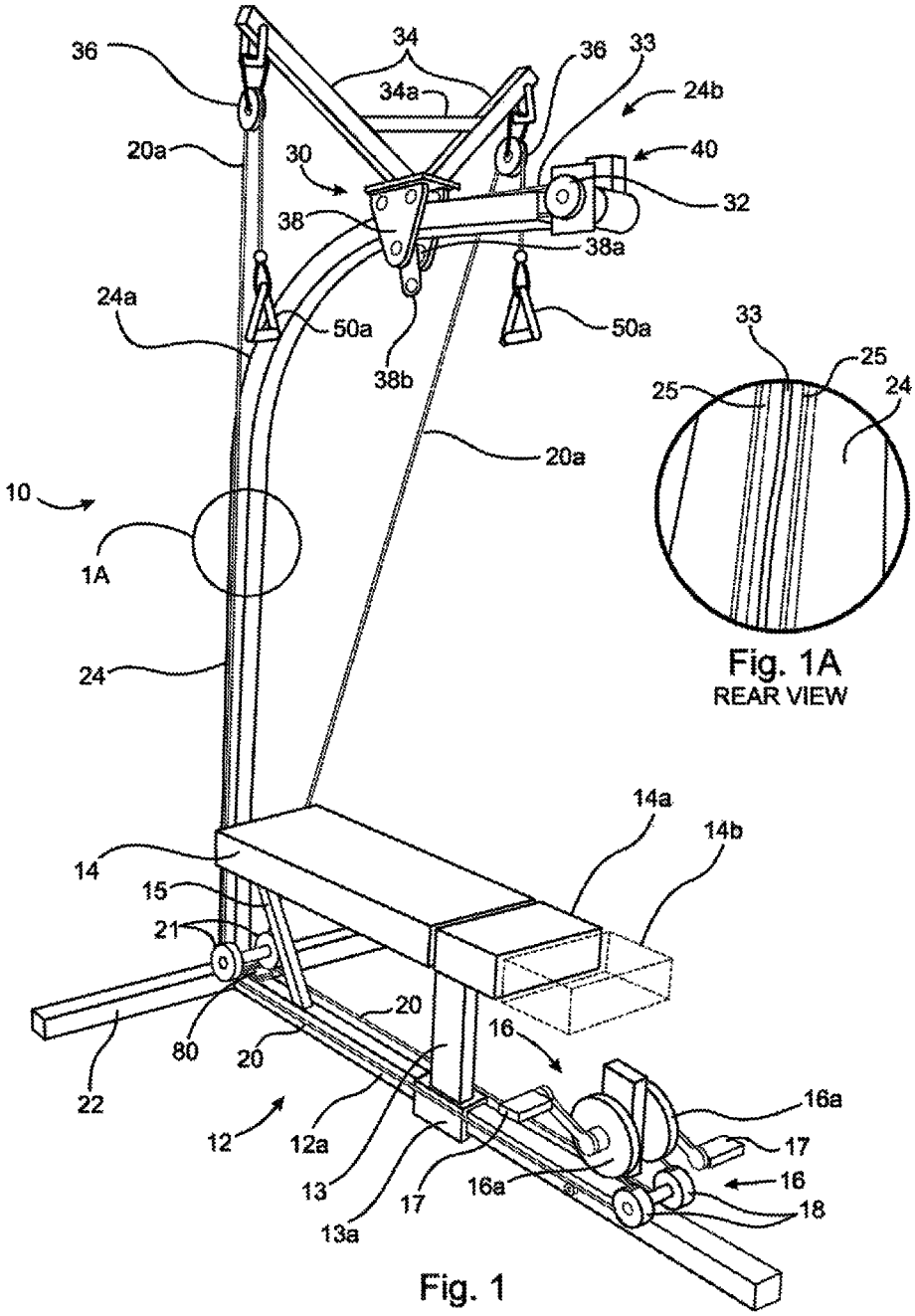
FIG. 1 is a front perspective view of one embodiment of the stretching machine of the present invention.
FIG. 1A is a rear view of a portion of the upright showing the carriage cable confined within channels fixed to the rear side of the upright.

Adverting to the drawings, FIG. 1 is a front perspective view of one embodiment of stretching machine 10 ("machine 10"). Stretching machine 10 includes a t-shaped base 12 ("base 12") having long arm 12*a* and short arm 22 attached substantially perpendicularly to long arm 12*a*. By substantially is meant in this context that the attachment of short arm 22 and base 12*a* is perceived by the ordinary user as perpendicular in orientation. At or near the junction of short arm 22 and base 12*a*, curved upright 24 ("upright 24") extends substantially perpendicularly from short arm 22 and then curves into arch 24*a* over long arm 12*a* such that distal end 24*b* is almost or substantially parallel to long arm 12*a*.

Bench 14 is attached to long arm 12*a* by means of bench post 13. In a preferred embodiment, adjustable support 13*a* is adjustably attached to long arm 12*a* and in conjunction with pivotable leg 15 allows bench 14 to move along some or all of the length of long arm 12*a*. Persons of skill in the art will recognize that other supports may be configured that allow bench 14 to be adjustably attached to long arm 12*a*. In one embodiment described below, back rest 14*c*, not seen in FIG. 1, is removably inserted into receiver 70, also not seen in FIG. 1, for use with some exercises. Also seen are bench extensions 14*a* and 14*b* which can be inserted into the support of bench 14 to lengthen it. Double reel cable drum assembly 16 ("assembly 16") is attached, preferably adjustably attached, to long arm 12*a* of base 12 and includes two individual cable reels 16*a*. By adjustably attached is meant that one component may be attached to a second component in more than one orientation and/or at more than one attachment point. In one embodiment, each one of a pair of cables 20 is wound around separate reels 16*a* and extend from reels 16*a* to pulleys 36 at the end of each of carriage arms 34. In a preferred embodiment, each of cables 20 extend around reel pulleys 18 to guide pulleys 21 located at the end of long arm 12*a* opposite from cable drum 16. In an alternate embodiment, cables 20 are each attached to a pair of cables 20*a* that extend similarly to arms 34 around pulleys 36. Pedals 17 attached to cable drum 16 are operated by a user U to wind and unwind cables 20 thereby applying or releasing tension in cables 20. In the embodiment shown, force or strain gauge 80 ("gauge 80") is seen near the junction of long arm 12*a* and short arm 22 under pulleys 21. One or both of pulleys 21 is functionally attached to gauge 80. In this case, functionally attached means that gauge 80 contacts or otherwise is connected to at least one of pulleys 21 to measure the force or strain applied by the user to pulleys 21 through cables 20. Persons of skill in the art will recognize that suitable gauges 80 are available commercially, such as Model Z2H by IMADA, Inc., 3100 Dundee Rd., Suite 707, Northbrook, Ill. 60062.

FIG. 1 also depicts one embodiment of the adjustable mounting of carriage 30 onto upright 24 of machine 10. Lateral guards 38 are attached on to carriage 30 and extend to either side of upright 24. Lateral guards 38 may be joined by attachment 38*a*. Grips 50*a* are attached to the end of cables 20 or 20*a*. As described below, grips 50*a* are one of a group of accessories 50 that may come in different shapes or sizes depending on the specific use by the operator. Also seen is pulley attachment 38*b* which can hold a central pulley 36.

In one embodiment, gear motor 40 ("motor 40") is attached to upright 24 at or near end 24*b*. Motor 40 is functionally attached to carriage 30 in such away as to enable a user or operator to move carriage 30 along upright 24 and hold it in an infinite number of positions along upright 24. By functionally attached is meant that the attachment between gear motor 40 and carriage 30 functions to control the movement of carriage 30 along some or all of the length of upright 24 and hold it in a chosen position on upright 24. In this embodiment, the functional attachment is carriage cable 33 as well as pulley 39 as described below. In this embodiment, carriage cable 33 is an adjustable attachment to upright 24 as the position of carriage 30 can be adjusted up or down on upright 24 using gear motor 40. FIG. 1A is a rear view of a portion of upright 24 showing carriage cable 33 confined with channels 25 which are fixed to the rear side of upright 24. Belts, chains, or similar devices may be substituted for cable 33.

Figure 1B:
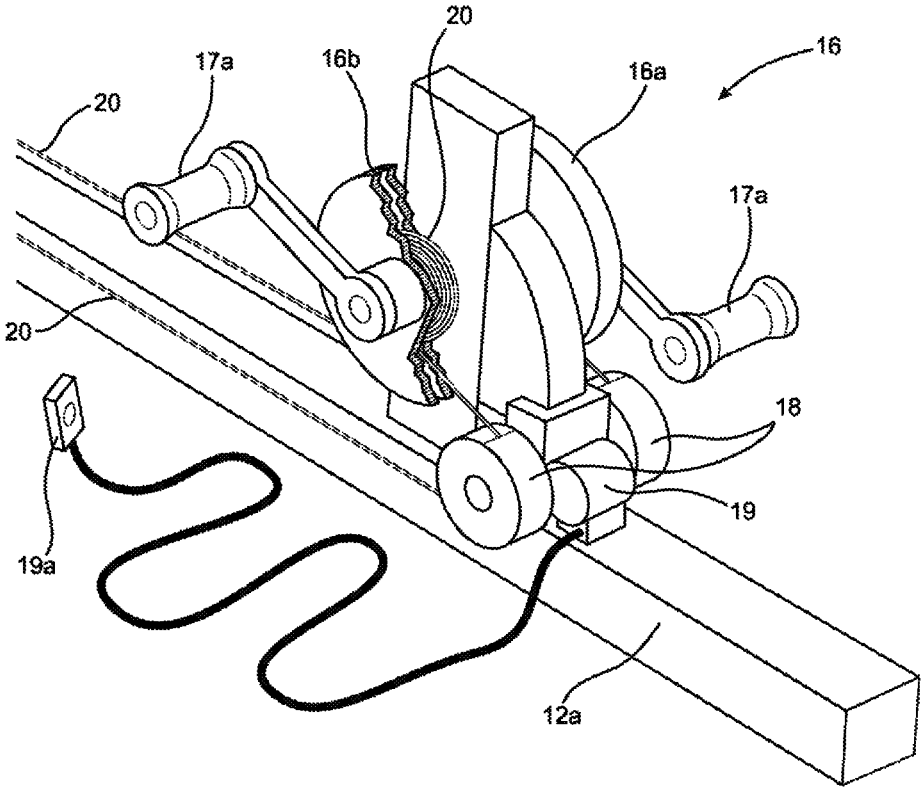
FIG. 1B depicts the best mode of winding the cable around the double cable reel as well as other alternate embodiments of the double cable reel assembly.

FIG. 1B depicts the best mode for cable reels 16*a* in that they are configured to form a narrow channel 16*b* so that cable 20 is wound around cable reel 16*a* on top of itself to form a single stack. FIG. 1B also shows an embodiment in which foot pedals 17 are replaced by handgrips 17*a* to rotate reels 16*a* by hand.

Also seen in FIG. 1B is an embodiment in which cable drum 16 is powered by motor 19. In a further embodiment, the user may control motor 19 with remote 19*a*. Persons of skill in the art will recognize that motor 19 may or may not be used at the user's option with either foot pedals 17 or rotatable hand grips 17*a*.

Figure 1C:
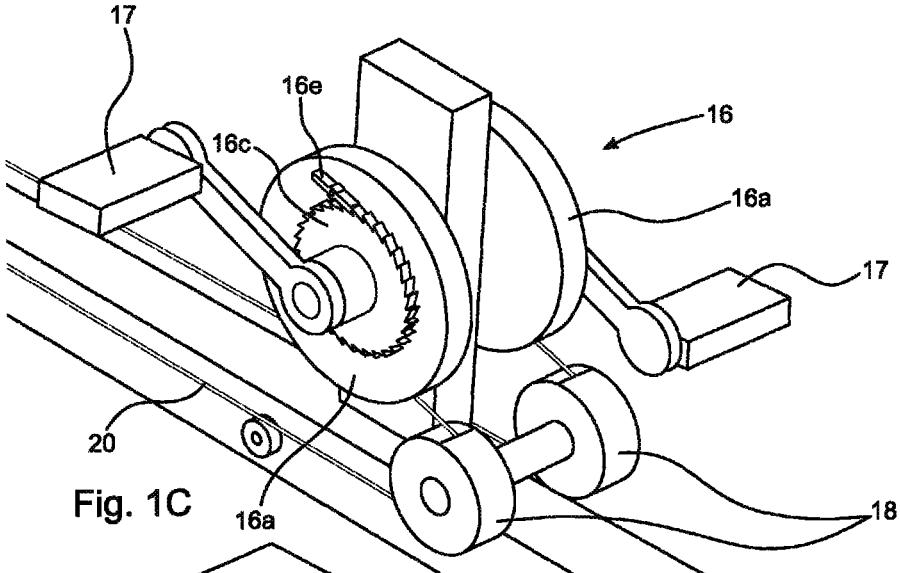
FIG. 1C is a top perspective view of an alternate embodiment of the double cable reel assembly of the present invention.
Figure 1D:
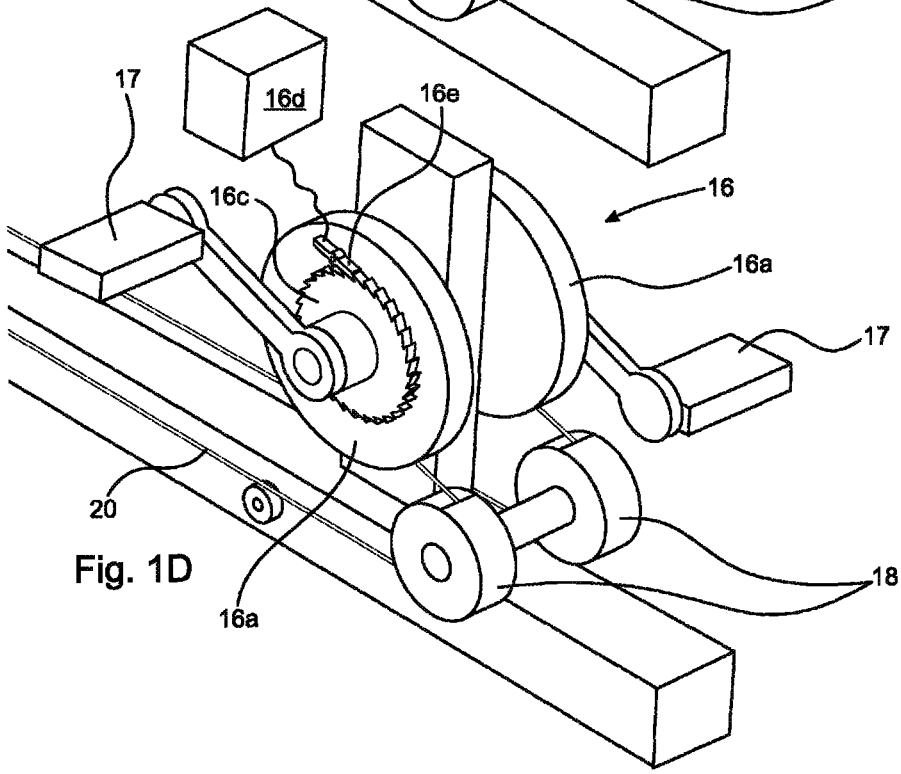
FIG. 1D is a top perspective view of a second alternate embodiment of the double cable reel assembly of the present invention.

FIG. 1C is a top perspective view of an alternate embodiment of double cable reel assembly 16. In the embodiment shown, a ratchet assembly including ratchet gear 16*c* with pawl or ratchet stop 16*e* may be used in conjunction with pedals 17 or handgrips 17*a* (not shown in FIG. 1C) to rotate double cable reel assembly 16 to wind or unwind cable 20 to a desired length using the ratchet to hold cable 20 in a desired position. Use of the ratchet provides the advantage of enabling a quick release of cable 20 when it is under tension, as well as the advantage of holding a desired position without a holding force applied to assembly 16 by the user. In a second alternate embodiment seen in FIG. 1D, solenoid 16*d* acts as a pawl for ratchet gear 16*c*. Solenoid 16*d* may be controlled by the user to hold and release ratchet gear 16*c* with a suitable hand-held or remote control device.

Figure 2:
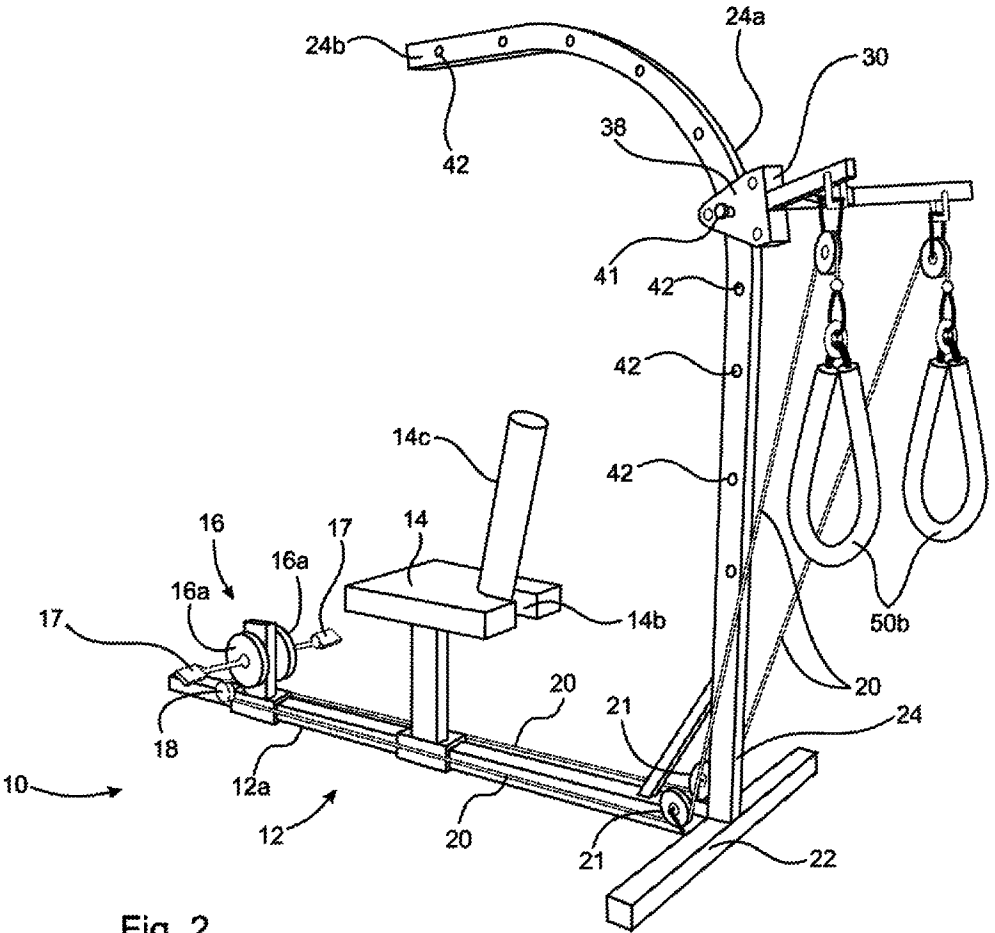
FIG. 2 is rear perspective view of an alternate embodiment of the present invention in which the carriage is held in position by pins inserted into holes in the curved upright.

FIG. 2 is a rear perspective view of an alternate embodiment of the invention in which carriage 30 is adjustably mounted onto upright 24 by inserting at least one pin 41 through one or more of a plurality of holes 42 that extend along all or part of the length of upright 24. Pin(s) 41 is removed from one hole(s) 42 and carriage 30 is then moved to the desired position. Pin(s) 41 is then inserted through hole(s) 42 to hold carriage 30 in the new position on upright 24. Also seen are alternate embodiments for bench 14 and accessories 50 in the form of seat 14 and back rest 14*c* and shoulder harnesses 50*b*, respectively. It can be seen that utilizing a curved upright 24 provides the advantage of allowing a user to perform stretches at a more graduated range of angles than would be possible with either a straight, i.e. noncurved, upright or an upright with a sharp corner-type change of direction.

Figure 3:
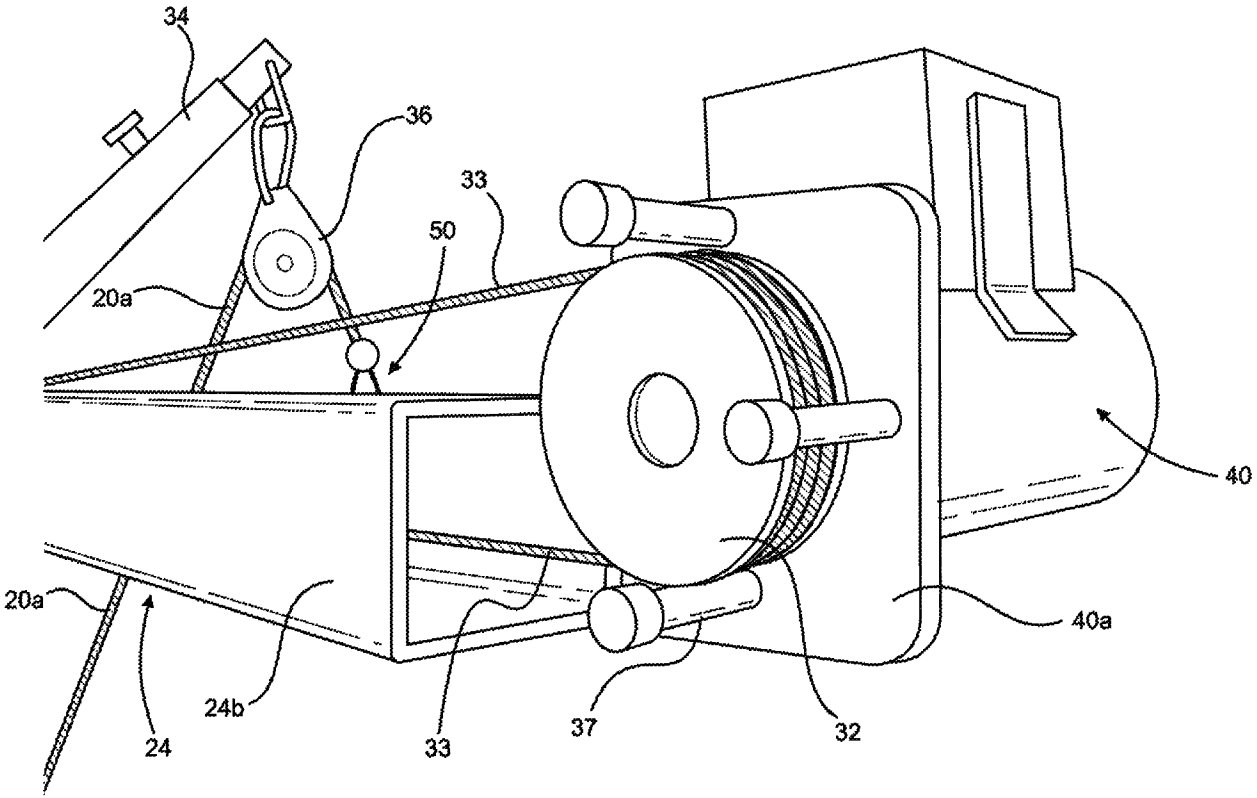
FIG. 3 is a close up side perspective view of the gear motor positioned at or near the end of the upright of the stretching machine of the present invention.

FIG. 3 is a close up side perspective view of gear motor 40 ("motor 40") at end 24*b* of upright 24. Motor 40 is functionally attached to carriage 33 through plate 40*a*. Motor 40 rotationally drives carriage cable reel 32 which holds carriage cable 33. Motor 40 rotates reel 32 to wind or unwind carriage cable 33 to move carriage 30 up or down upright 24. Preferably, cable guide 37 is directly below cable reel 32 to guide carriage cable 33 as it is wound onto or unwound off cable reel 32. More preferably, cable 33 is wound at least three times around reel 32.

Figure 3A:
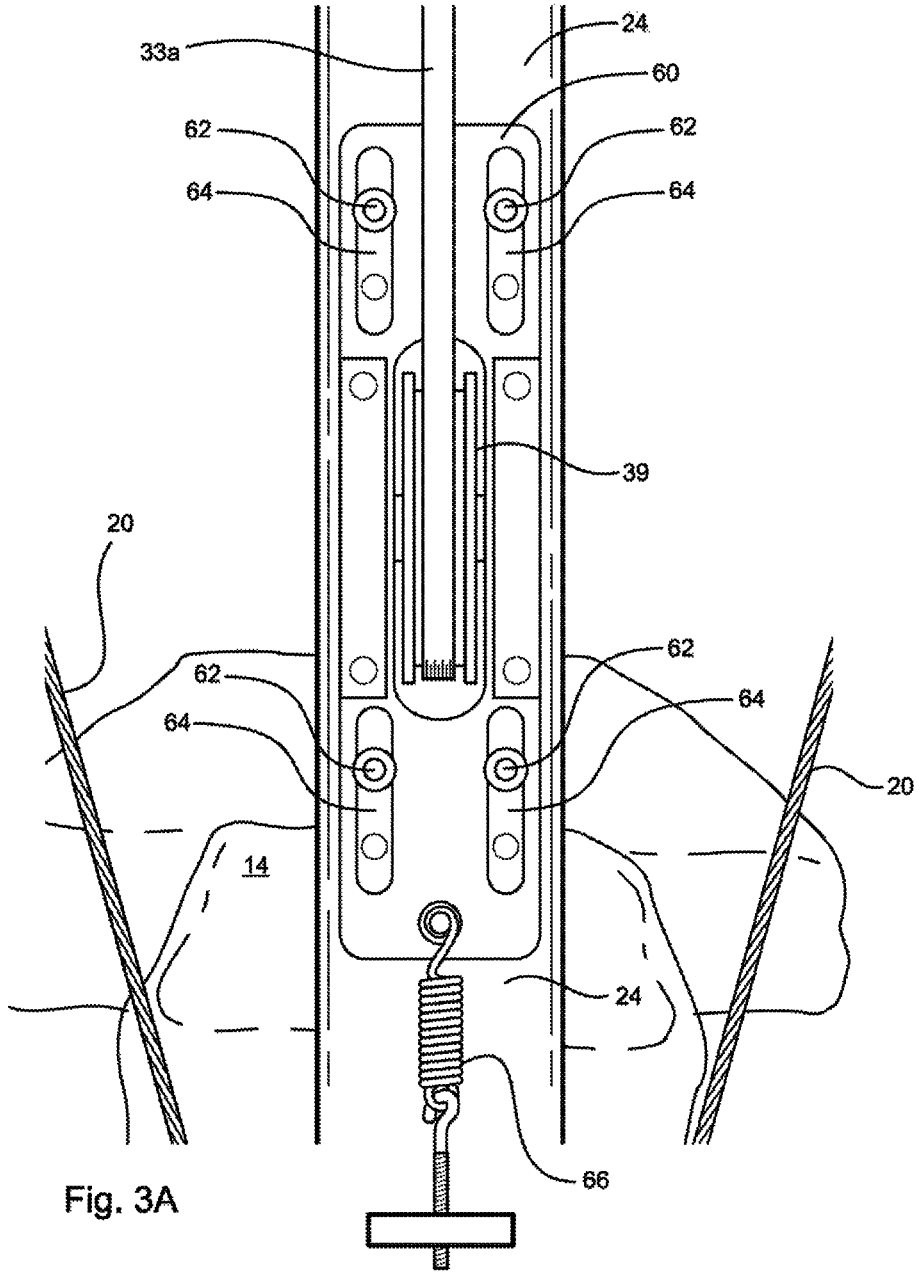
FIG. 3A is a rear view of the stretching machine showing the cable pulley positioned in the perpendicular portion of the upright directing the carriage pulley from the gear motor to the carriage along the upright.

FIG. 3A is a rear view of machine 10 showing carriage cable pulley 39 ("pulley 39") positioned in the perpendicular portion of upright 24 near the level of bench 14. In this view, the functional attachment is belt 33*a* which winds from cable reel 32 through the inside of hollow upright 24 around pulley 39 and extends to carriage 30. In an alternate embodiment, cable 33 or belt 33*a* may extend externally on the opposite side of upright 24 around pulley 39 to carriage 30. Cable 33 is attached to carriage 30 so that when cable 33 winds onto reel 32 from the top side, carriage 30 is pulled up upright 24 toward end 24*b*. When cable 33 winds off cable reel 32 from the top side, carriage 30 is moved down upright 24 toward short arm 22. Carriage 30 is adjustably attached to upright 24 so that it is laterally stabilized to prevent a sideways fall from upright 24. It can be seen in FIGS. 1 and 2 that lateral guards 38 prevent carriage 30 from falling laterally off upright 24 while attachment 38*a* keeps it from falling back away from upright 24.

FIG. 3A also shows floating bracket 60 which holds pulley 39. Floating bracket 60 moves up and down on pins 62 extending through slots 64 as tension on carriage belt 33*a* changes during movement of carriage 30. Tension spring 66 maintains bias on pulley 39 to remove any slackness in belt 33*a* or cable 33.

Figure 3B:
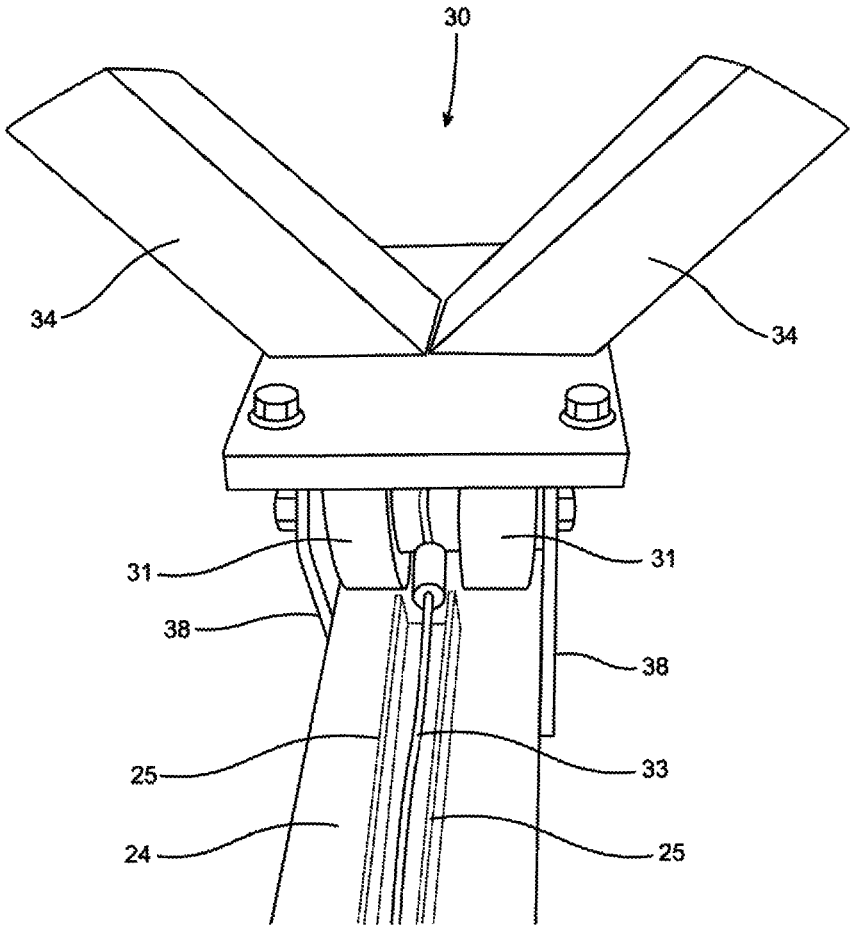
FIG. 3B is a rear view of the carriage held in position on the upright.

FIG. 3B is a rear view of carriage 30 at the point at which it rests on upright 24. Carriage cable 33 is attached to a rear roller assembly comprising an axle and two rollers 31. Preferably, cable 33 is confined between channels 25 as seen in FIG. 1A. Cable 33 extends to pulley 39 seen in FIG. 3A and from there to cable reel 32. Thus, it can be seen that both ends of carriage cable 33 are attached to carriage 30 to control its movement through operation of cable reel 32 to wind cable 33 on clockwise or counterclockwise around cable reel 32.

Figure 4:
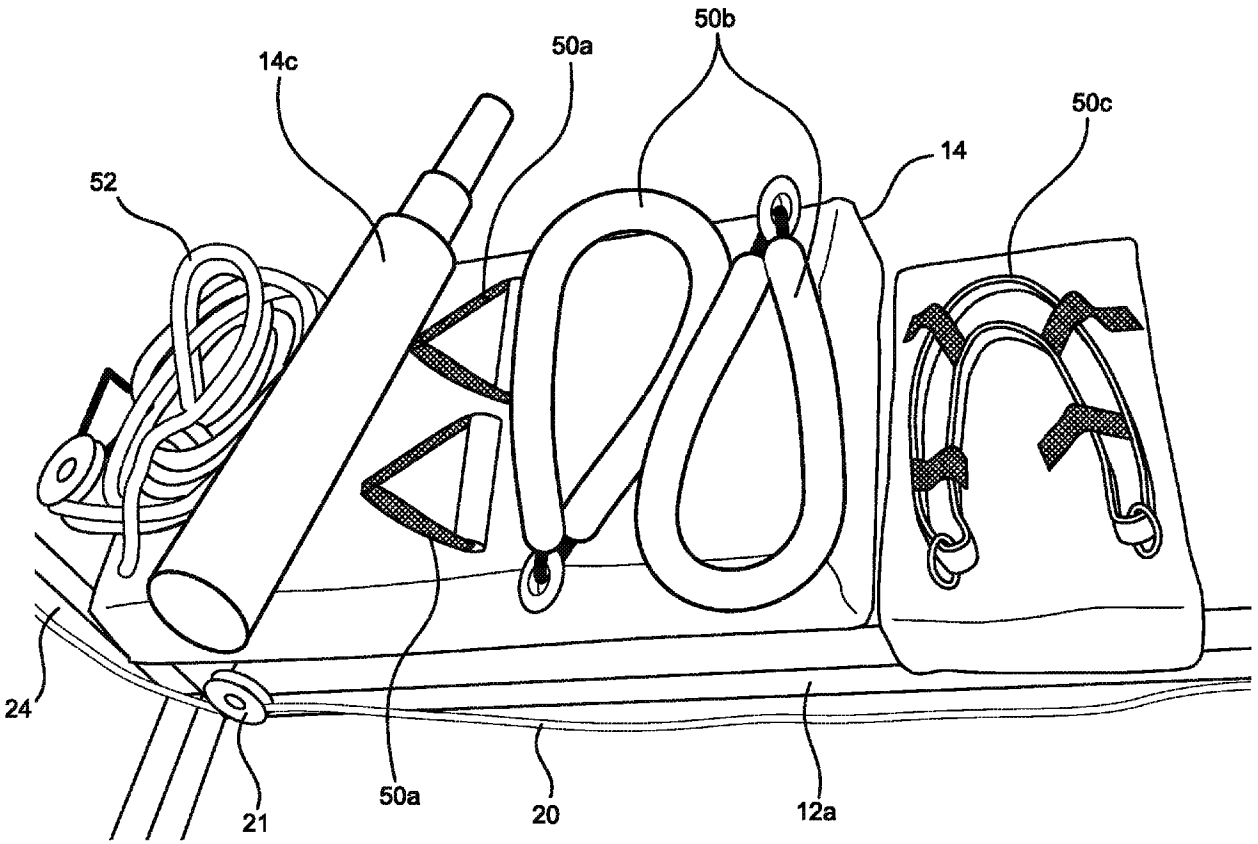
FIG. 4 is a view of various embodiments of the grips and harnesses (collectively "accessories") attached to the ends of the cables to apply stretching exercises to various parts of the body.

FIG. 4 is a view of various embodiments of grips and harnesses (collectively "accessories 50") that may be attached to the ends of cables 20 or 20*a* to apply stretching exercises to various parts of the body. Hand grips 50*a*, shoulder harnesses 50*b*, and neck harness 50*c* are seen on bench 14. Also seen is rope 52, which is used in some of the stretching exercises, and back rest 14*c*. Persons of skill in the art will recognize that other forms of accessories 50 may be used with machine 10.

FIG. 5 depicts one embodiment of the adjustable receiver 70 for back rest 14*c* in which back rest 14*c* may be adjusted to different angles relative to bench 14. Sleeve 70 is seen extending through bench opening 14*d* to receive back rest 14*c*. Persons of skill in the art will be aware that sleeve 70 may be adjusted in height as needed. As described below, handle 72 is turned to adjust the angle at which back rest 14*c* extends above bench 14. Also shown are slots 15 which receive bench extension 14*a*. As is evident from FIG. 5, bench extension 14*a* can be inserted at different levels to allow the user to adjust the level at which his/her hips lay on the bench. This enables the user to perform exercises at different angles allowing the user to perform a more complete workout or rehabilitation session. Similar slots or, alternatively, other forms of attachment may be used to receive extension 14*b* seen in FIG. 1.

FIG. 5A is a schematic side view of an adjustment mechanism for back rest 14*c*. Sleeve 70 is pivotally connected to bracket 77 by pivot pin 74. Sleeve 70 is also attached to threaded rod 78 ("rod 78") which is threadably attached to bracket 77 at threaded hole 72*b*. Threaded rod also extends through orifice 72*a* which is defined by bracket 77. As handle 72 turns, it moves rod 78 back and forth through bracket 77. This linear motion causes adjustment pin 76 to rotate sleeve 70 on pivot pin 74 to the desired angle as shown by the double arrow. Adjustment pin 76 is attached to rod 78 through jacket 79. Persons of skill in the art will be aware of several devices that can be used to lock handle 72 into a specific position once the desired angle is reached.

Figure 6:
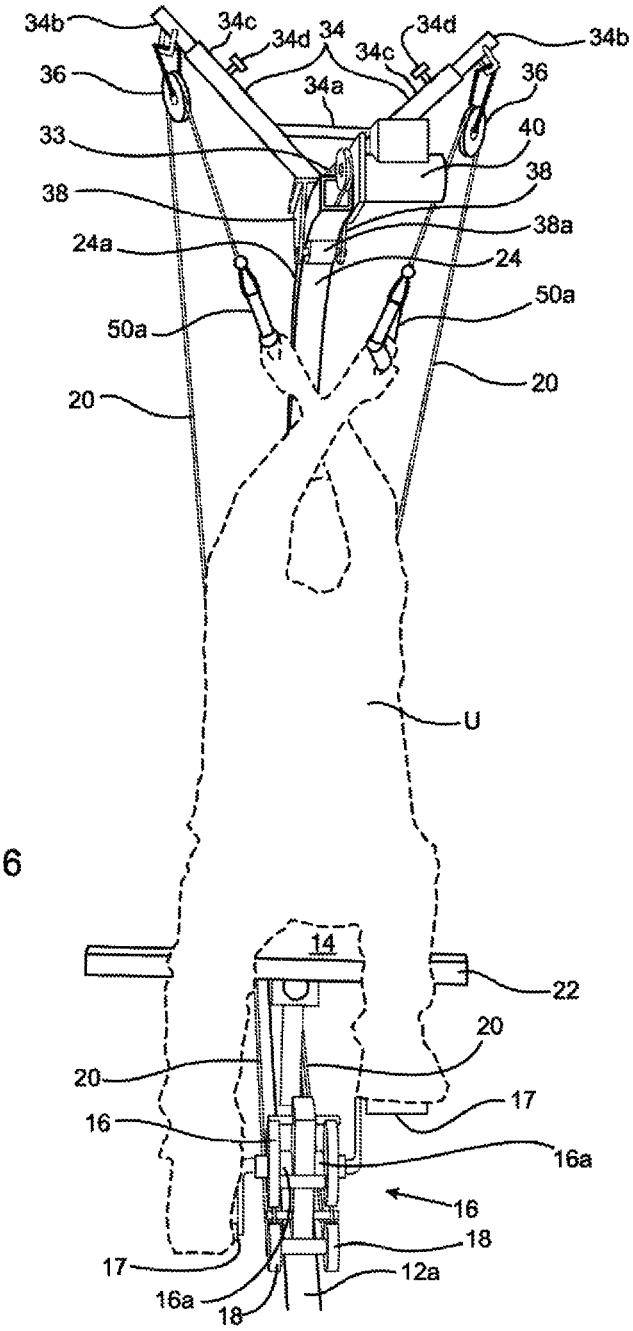
FIG. 6 is a front view showing one of the stretching exercises utilizing the hand grips in a crossing stretching exercise.

FIG. 6 is a front view showing one of the stretching exercises utilizing hand grips 50*a*. It can be seen that the user is operating cable foot pedals 17 to pull his arms in an angled crossing upward stretch. Note the position of carriage 30 at the top of arch 24*a* of upright 24. Bridge 34*a* is seen connecting arms 34. In the embodiment shown, arms 34 are telescoped such that arm portion 34*b* fits into arm sleeve 34*c* and is locked into position by lock 34*d*. Also seen clearly is the configuration of cable drum 16 into double reels 16*a*, each reel 16*a* holding a separate cable 20.

Figure 7:
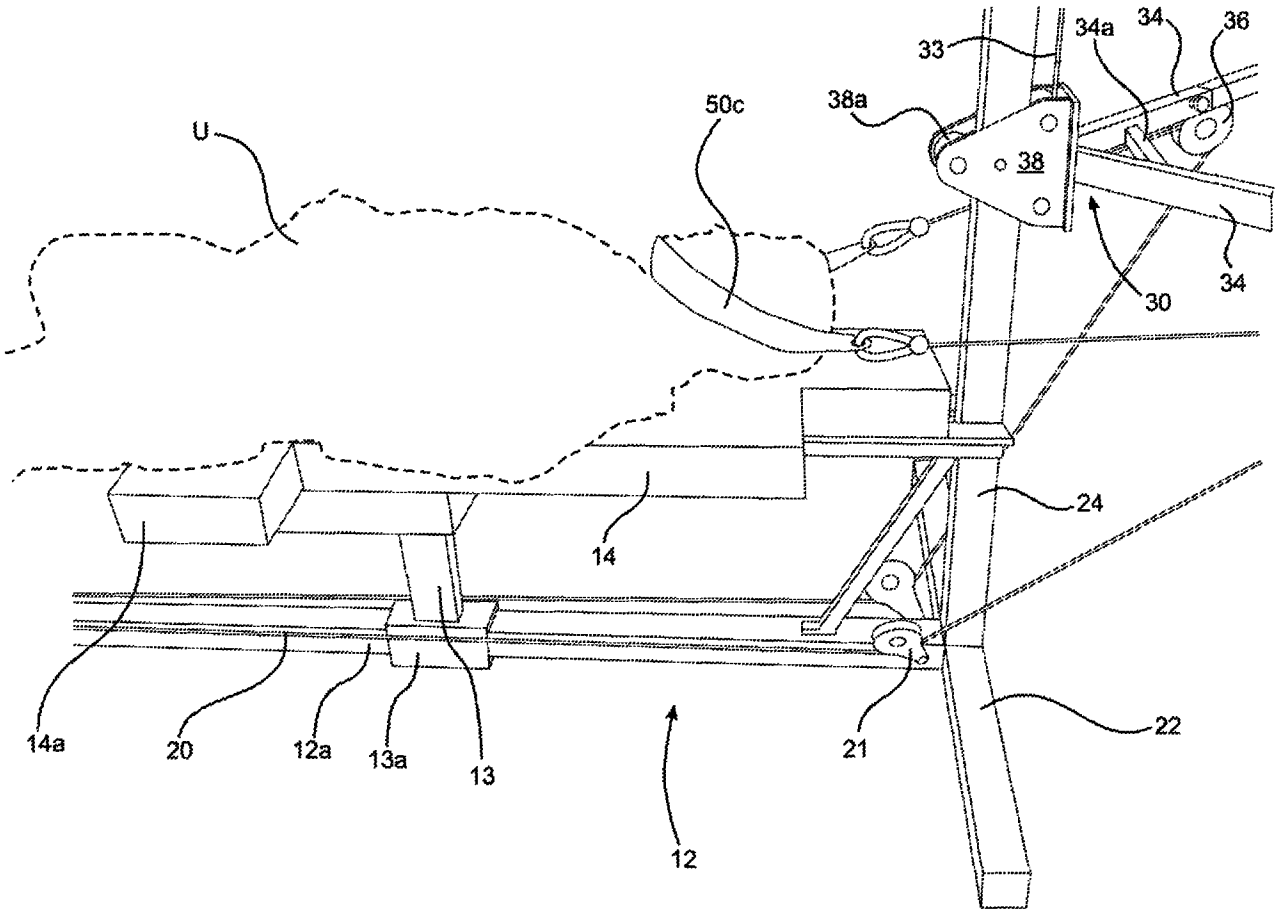
FIG. 7 is a side perspective view of the stretching machine of the present invention being utilized for a neck stretching exercise.

FIG. 7 is a side perspective view of stretching machine 10 being utilized for a neck stretching exercise. Neck harness

50*c* is wrapped under the chin of the user U after which user U operates cable drum assembly 16 (not seen in FIG. 7) to pull cables 20 to apply stretching force on the neck. It can be seen that carriage 30 has been lowered down upright 24 to a different position just above bench 14 and is held by the attachment to gear motor 40 through cable 33. Pulley 36 is shown as moved down from the end of arm 34 closer to bridge 34*a*.

Figure 8:
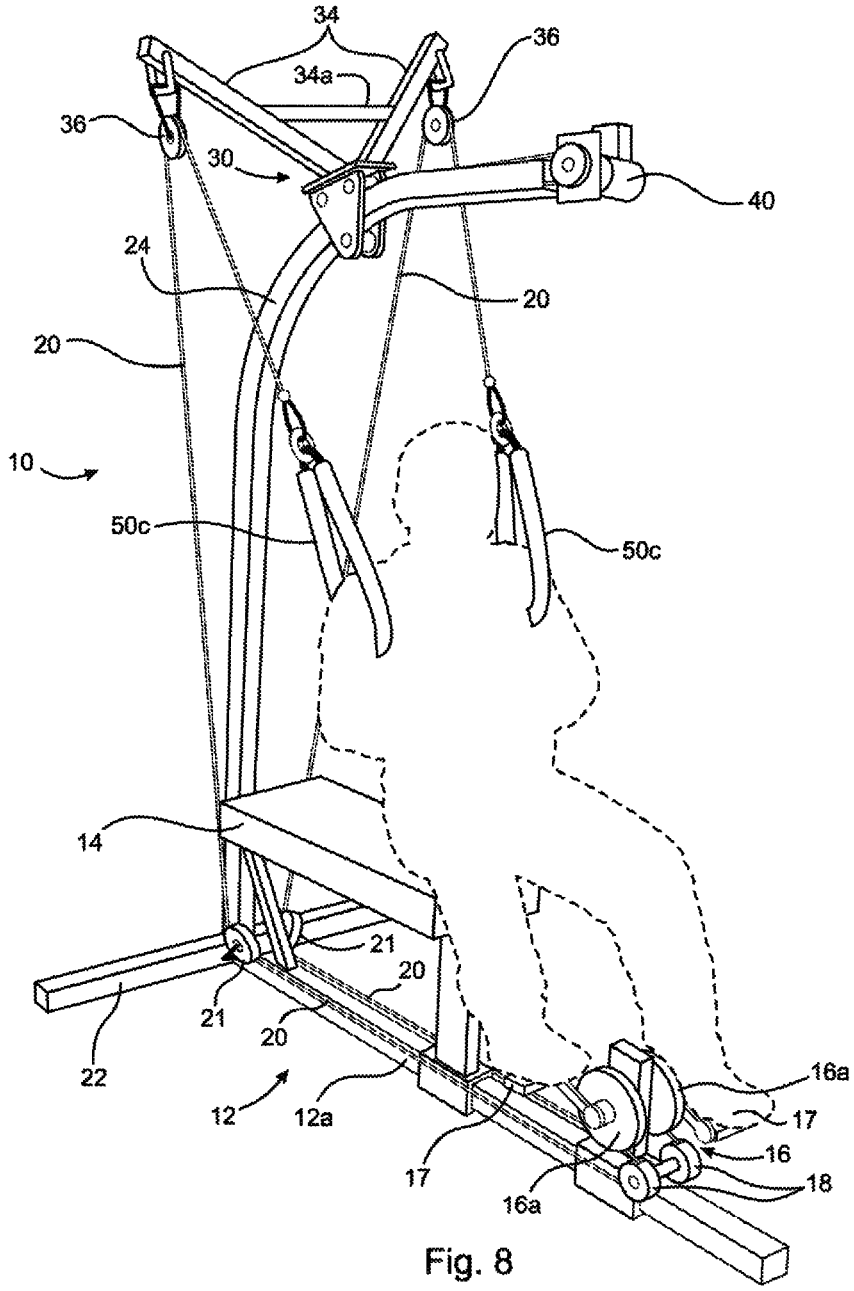
FIG. 8 is a front perspective view of the stretching machine utilizing shoulder harnesses with the carriage adjusted to a different position on the upright.
Figure 8A:
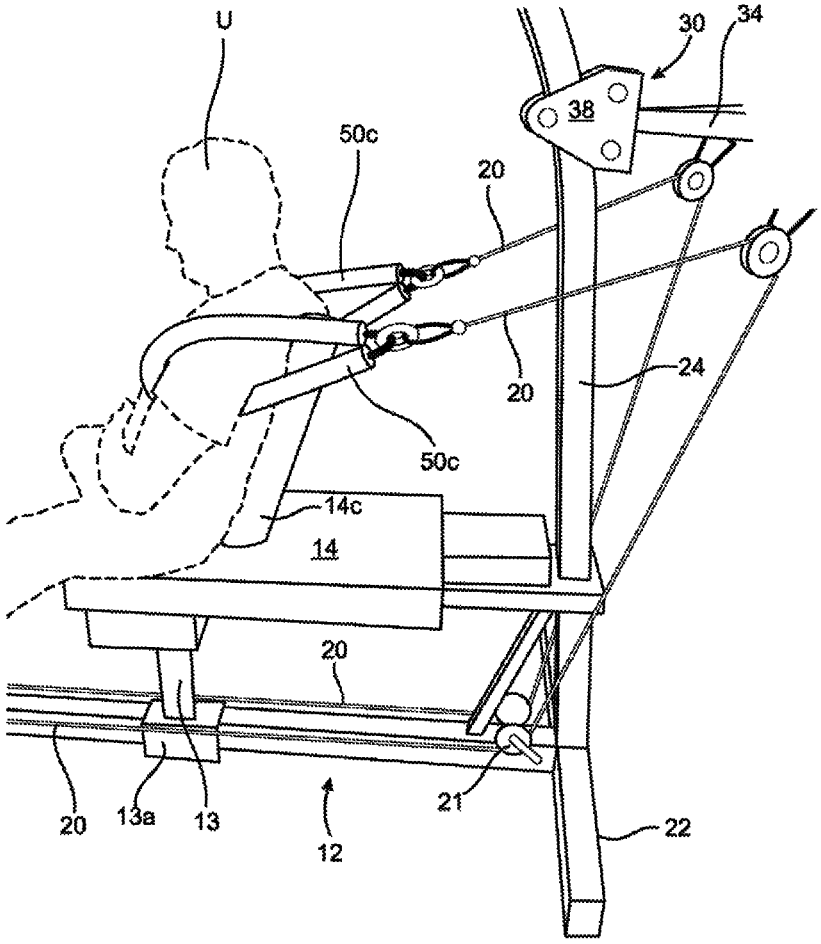
FIG. 8*a* shows a second position of the carriage closer to the bench while still using the shoulder harnesses.

FIG. 8 is a front perspective view of user U on stretching machine 10 utilizing shoulder harnesses 50*c* with carriage 30 adjusted to a different position on upright 24. Carriage 30 is held at curve 24*a* of upright 24. This position of carriage 30 allows the shoulders to be stretched upwards generally toward curve 24*a* while user U is in a sitting position. FIG. 8*a* shows a second position of carriage 30 closer to bench 14 while still using shoulder harness 50*c*. User U is seen using back rest 14*c*. In comparing the position of carriage 30 with that of FIG. 7, it can be seen that machine 10 can be utilized to apply stretching force at a variety of angles by varying the position of carriage 30 on upright 24.

Figure 9:
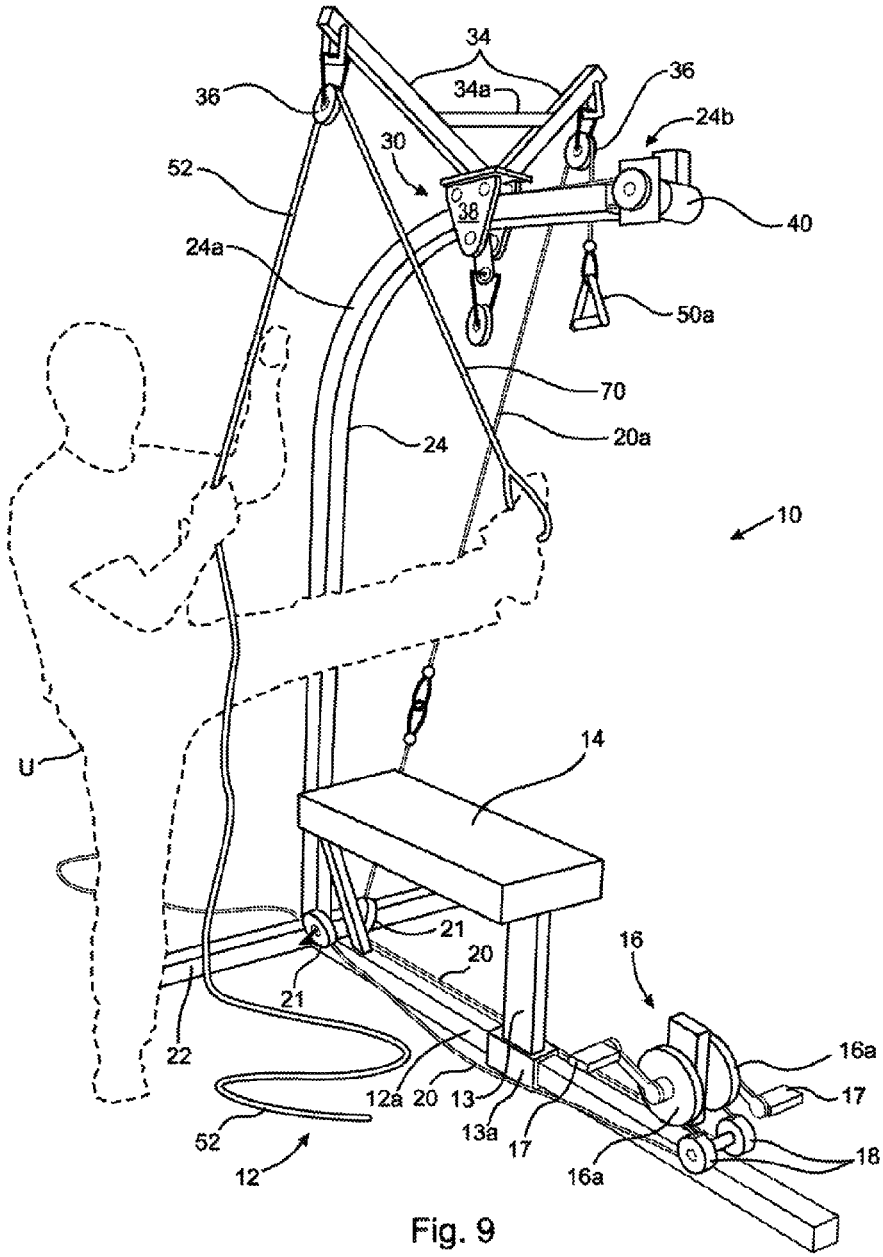
FIG. 9 is a front perspective view depicting the use of the stretching machine to apply stretching forces to a user's leg; and, FIG. 10 is a front perspective view showing the use of the bench and carriage pulley to apply stretching forces to a user's leg.

FIG. 9 is a front perspective view depicting the use of the stretching machine 10 to apply stretching forces to user's U leg. Carriage 30 has been moved toward end 24*b* of upright 24. Arm pulley 36 supports rope 52 which is wrapped around one foot of user U. Similar to the previous figures described above, user U directly controls the force applied to his own leg. It will be recognized that other positions will allow user 60 to stretch the leg at different angles.

Figure 10:
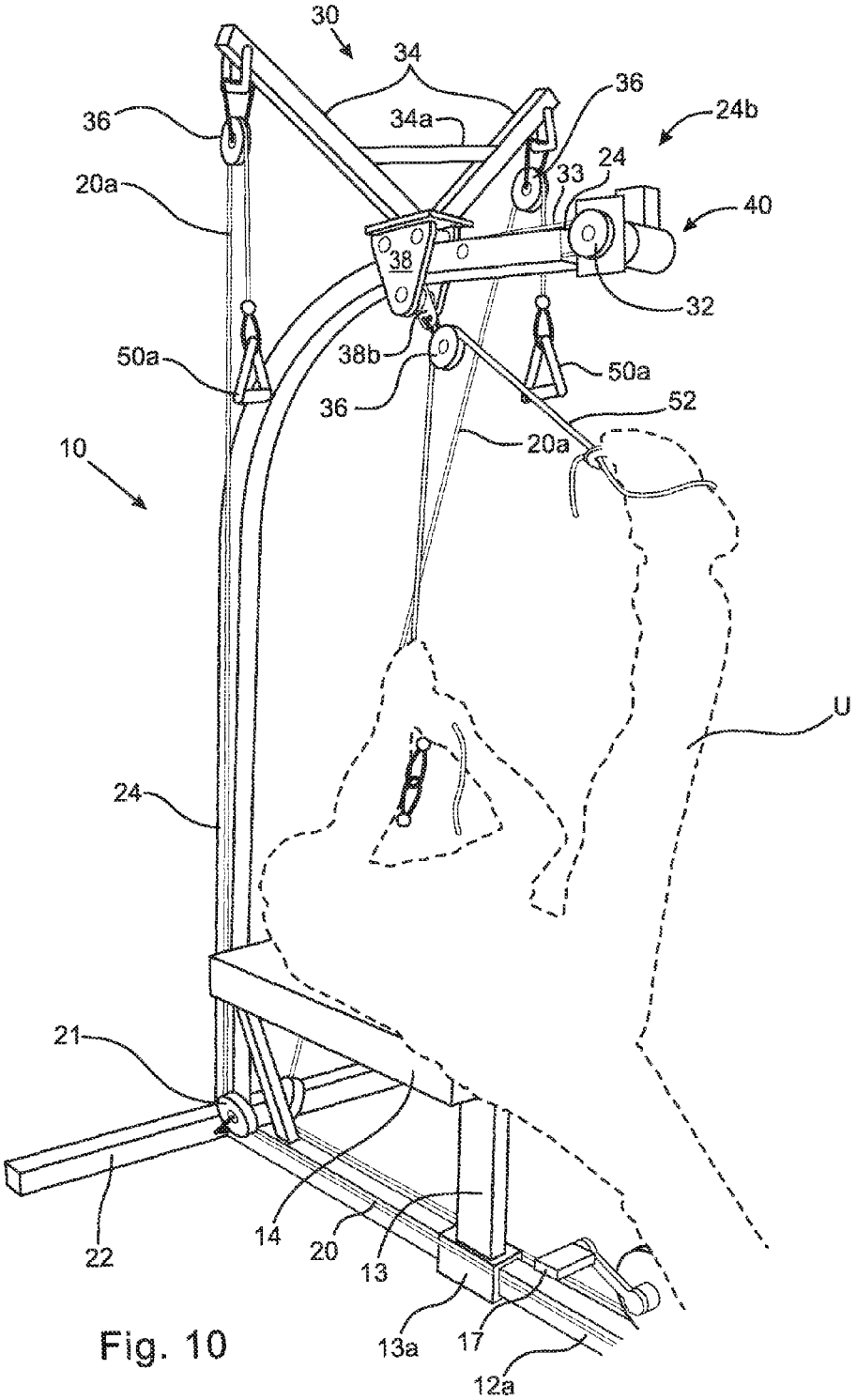

FIG. 10 is a front perspective view of machine 10 in which user U is performing a stretch using central pulley 36 attached to attachment 38*b*. It can be seen that bench 14 and carriage 30 can be used for some stretches without using double cable reel 16.

Thus it is seen that the objects of the invention are efficiently obtained, although changes and modifications to the invention should be readily apparent to those having ordinary skill in the art, which changes would not depart from the spirit and scope of the invention as claimed.

We claim:

1. A stretching machine comprising:

a base formed by a long leg and short leg, said short leg attached substantially perpendicularly to said long leg;

a curved upright extending substantially perpendicularly from said short arm of said base;

a carriage adjustably mounted onto said curved upright;

a pair of arms extending angularly from said carriage;

a pair of carriage pulleys attached at the end of each of said pair of arms;

a double cable reel assembly adjustably attached to said long leg, said double cable reel assembly including two individual cable reels;

a pair of cables, each one of said pair of cables extending from one of said individual cable reels to one of said pair of carriage pulleys; and, a seat adjustably attached to said base between said double cable reel assembly and said curved upright.

2. The stretching machine as recited in claim 1 further comprising a pair of guide pulleys positioned between said seat and said curved upright.

3. The stretching machine as recited in claim 2 further comprising at least one force gauge to measure the force on at least one of said pair of cables.

4. The stretching machine as recited in claim 1 wherein said seat is a bench.

5. The stretching machine as recited in claim 1 wherein said seat includes a back.

6. The stretching machine as recited in claim 5 wherein said back is adjustable.

7. The stretching machine as recited in claim 1 further comprising at least one seat extension removably attached to said seat.

8. The stretching machine as recited in claim 1 further comprising stretching accessories removably attached to the end of at least one cable.

9. The stretching machine as recited in claim 8 wherein said stretching accessories are selected from a group comprising hand grips, shoulder harness, head harness, rope, and neck harness.

10. The stretching machine as recited in claim 1 wherein said adjustable mounting comprises a plurality of holes positioned along the length of said upright and at least one pin functionally attached to said carriage, wherein said at least one pin is inserted into at least one of said plurality of holes.

11. The stretching machine as recited in claim 1 wherein said adjustable mounting is a motor functionally attached to said carriage to move said carriage along said curved upright.

12. The stretching machine as recited in claim 11 wherein said motor includes a carriage cable reel and said functional attachment includes a carriage cable extending from said carriage cable reel to said carriage.

13. The stretching machine as recited in claim 12 further comprising a carriage cable pulley located on said curved upright wherein said carriage cable extends to said carriage around said carriage cable pulley.

14. The stretching machine as recited in claim 1 further comprising at least one foot pedal attached to each one of said double cable reels.

15. The stretching machine as recited in claim 1 further comprising at least one hand grip attached to each one of said double cable reels.

16. The stretching machine as recited in claim 1 further comprising a ratchet assembly attached to at least one of said double cable reels.

17. The stretching machine as recited in claim 16 wherein said ratchet assembly includes a solenoid-operated pawl.

18. The stretching machine as recited in claim 1 further comprising a pulley attached to said carriage and adapted to receive a stretching accessory.

* * * * *